United States Patent [19]

Decaux

[11] 4,162,585

[45] Jul. 31, 1979

[54] DISPLAY PANEL WITH MOVABLE POSTERS

[75] Inventor: Jean-Claude Decaux, Paris, France

[73] Assignee: J. C. Decaux Paris, Publicite Abribus, Boulogne-Billancourt, France

[21] Appl. No.: 804,247

[22] Filed: Jun. 7, 1977

[30] Foreign Application Priority Data

Jun. 9, 1976 [FR] France ..... 76 17326

[51] Int. Cl.[2] ..... G09F 11/24

[52] U.S. Cl. ..... 40/518; 40/471

[58] Field of Search ..... 242/57.1; 40/385, 518, 40/471

[56] References Cited

U.S. PATENT DOCUMENTS

| | | | |
|---|---|---|---|
| 1,840,692 | 1/1932 | Borowsky | 40/471 |
| 2,171,857 | 9/1939 | Mageoch | 40/471 |
| 2,803,900 | 8/1957 | Jones | 40/471 |
| 3,322,963 | 5/1967 | Pages | 242/57.1 |
| 3,701,318 | 10/1972 | Lozeau et al. | 242/57.1 |
| 3,780,458 | 12/1973 | Jacoby | 40/471 |
| 3,822,493 | 7/1974 | Maley | 40/471 |
| 3,857,525 | 12/1974 | Gerber et al. | 242/57.1 |
| 3,918,185 | 11/1975 | Hasala | 40/437 |

FOREIGN PATENT DOCUMENTS

| | | | |
|---|---|---|---|
| 1362262 | 12/1964 | France | 242/57.1 |

*Primary Examiner*—Louis G. Mancene
*Assistant Examiner*—Paul J. Hirsch

[57] ABSTRACT

This display panel for a plurality of posters to be displayed sequentially comprises a pair of spools, namely a feed spool and a take-up spool, and drive means for causing each spool to become by turns the feed spool and the take-up spool, and means for automatically correcting the lateral shift of the poster band by reducing the tension exerted on the paper on the side opposite the buckling side, or, in other words, for creating on the side opposite said observed buckling another compensating effect buckling so as to change the orientation of said shift, which in any case is detected by means known per se; the correction means are such that they modify the inclination of one spool in relation to the other in the poster plane in order to reduce the distance between the axes of the two spools on the side opposite the buckling of said poster band which is due to a reduction in the paper tension.

4 Claims, 5 Drawing Figures

DISPLAY PANEL WITH MOVABLE POSTERS

BACKGROUND OF THE INVENTION

1. Field of the Invention

The present invention relates to a display panel comprising a band of posters which has its two ends wound on a pair of spools, respectively, one being the feed spool when the other is the take-up spool, and vice-versa.

A known problem in the art is to find some means for compensating or correcting the poster band "drift" due to the local and irregular elongation or shrinking of the poster as a consequence of particular temperature, humidity or other conditions, including the prolonged exposure to sun rays, this elongation or shrinking being more marked in the case of a poster having one half exposed to sunlight and the other half kept in the shadow. Moreover, the spools are not always strictly parallel and the paper is not always exactly perpendicular to the spool axis, these factors further assisting in increasing the drift. Consequently, the poster band tends to slide on one or the other side during the winding thereof; if the band tends to become elongated on one side, a marked buckling of this side will be observed on the take-up spool, due to the decrease in the paper tension. Under these conditions, the paper will tend to coil up with a certain taper, since the band of posters is drifted transversely from the base of the cone, where the buckling takes place, to the top of the cone.

2. Description of the Prior Art

In the U.S. Pat. No. 3,726,031 delivered to Singer a typical solution of this problem is proposed. This patent discloses a poster or display panel comprising a supporting panel and a band of posters wound at either end on a pair of driven spools, respectively, said driven spools being positioned behind the panel and said band of posters passing over a pair of intermediate rollers mounted for loose rotation and located at the top and bottom of the panel. The drift is corrected by inclining the two driven spools which remain constantly parallel to each other, by means of a relatively complicated mechanism; thus, the poster driven laterally on the intermediate rollers is properly re-centered.

To avoid the inconvenience of this lateral shift, the present invention provides means for reducing the tension exerted on the paper on the side opposite the buckling side, or, in other words, for creating on the side opposite said observed buckling another compensating effect buckling so as to change the orientation of said shift, which in any case is detected by means known per se.

SUMMARY OF THE INVENTION

For this purpose, the display panel with movable posters according to this invention, which comprises a pair of spools rotatably mounted in a frame structure, one spool being the feed spool and the other the take-up spool, and vice-versa; a poster band having each end wound on one of said spools, said band being adapted to be reeled off one spool (which becomes the feed spool) and wound on the other spool (which becomes the take-up spool); means for driving said spools when they are in their take-up condition; other means for constantly detecting the possible drift of the poster band and means for correcting the drift, which are controlled by said detecting means, is characterized essentially in that the correction means are such that they modify the inclination of one spool in relation to the other in the poster plane in order to reduce the distance between the axes of the two spools on the side opposite the buckling of said poster band which is due to a reduction in the paper tension.

Therefore, in this invention neither intermediate rollers nor complicated mechanisms are used and the correction is obtained not by inclining the two spools simultaneously while preserving their parallel relationship, but by inclining one of the spools in relation to the other. More particularly, the arrangement may be such that only one spool can be inclined, preferably about one of its ends, now upwardly, now downwardly, according to the direction of propagation of the band drift. According to a particularly advantageous form of embodiment of the device of this invention, the inclination of one spool is controlled by means of a screw-jack extending normally to this spool in the plane of the poster disposed between the two spools.

Conventional drift detecting means consisting notably of a pair of photocells reading the posters along their edges and at mid-height are used.

The display panel according to this invention may also comprise, if desired, means known per se for discontinuing the poster band motion during a predetermined time period, so that at each stop a complete poster appears behind the observation window of the display panel, together with means known per se for detecting the passage of the last poster in registration with said observation window and subsequently reversing the direction of motion of the band.

Furthermore, means also known per se may be provided for tensioning each poster during its travel; now these means will safely preserve their maximum efficiency since the band drift is corrected continuously; these tensioning means may consist for example of devices capable on the one hand of braking the spools when they operate as feed spools during the movement of said poster band, and on the other hand of imparting a contrary motion to said spools when this movement is continued.

Two typical forms of embodiment of this invention will now be described by way of illustration, not of limitation, with reference to the attached drawings, in which:

DESCRIPTION OF THE PREFERRED EMBODIMENTS

Figure 1:
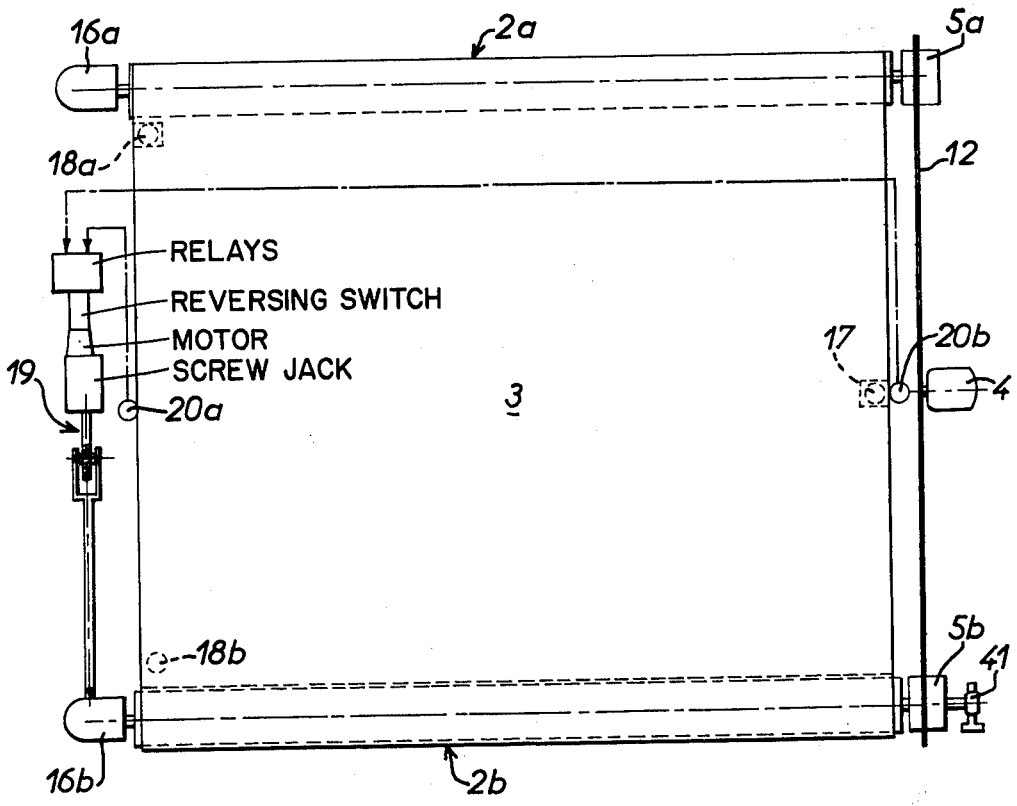
FIG. 1 is diagrammatic front elevational view of a display panel according to this invention.
Figure 2:
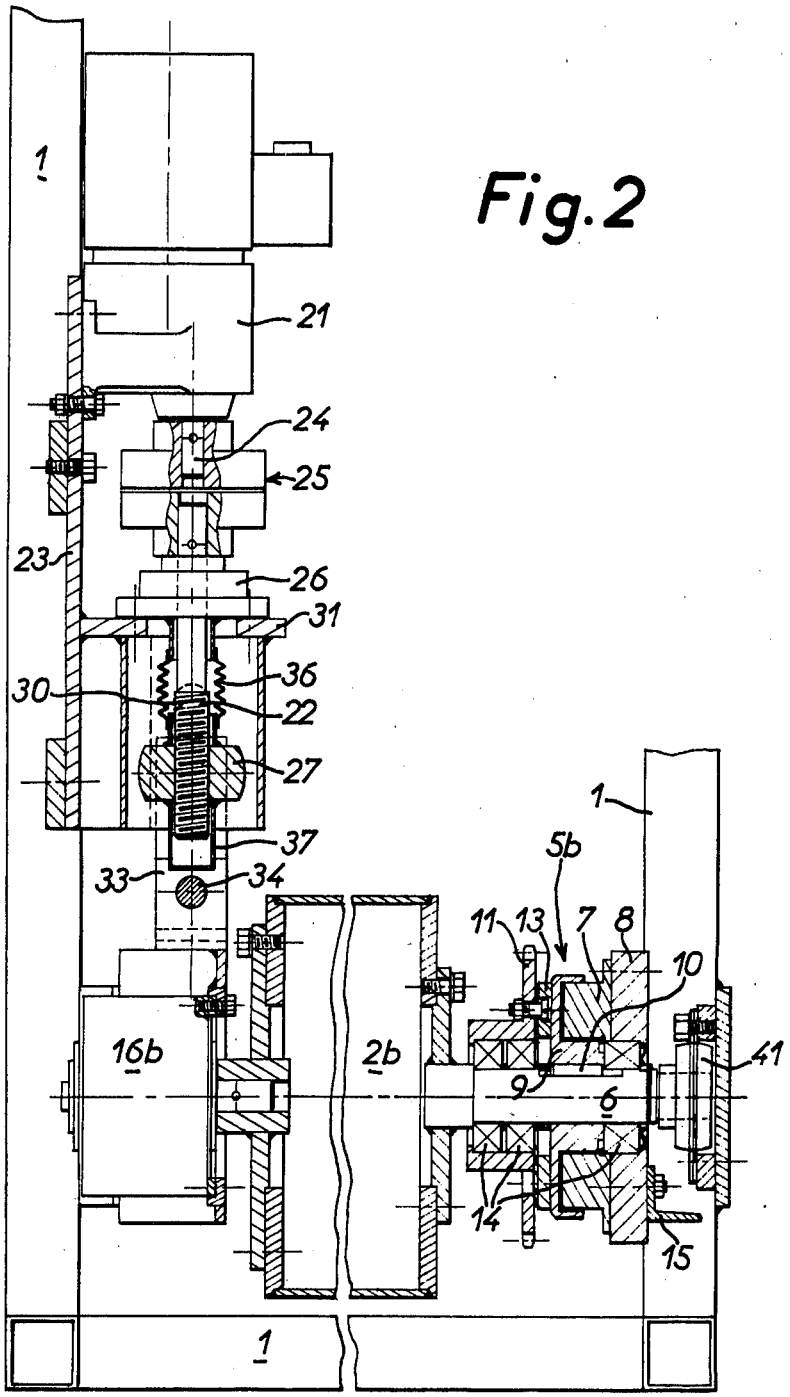
FIG. 2 is a fragmentary longitudinal axial section taken along the plane containing the axes of both spools, this Figure showing more particularly the bottom spool of the panel which comprises notably a screw-jack controlling the movements of said spool as a function of irregularities occurring in the band movement.
Figure 3:
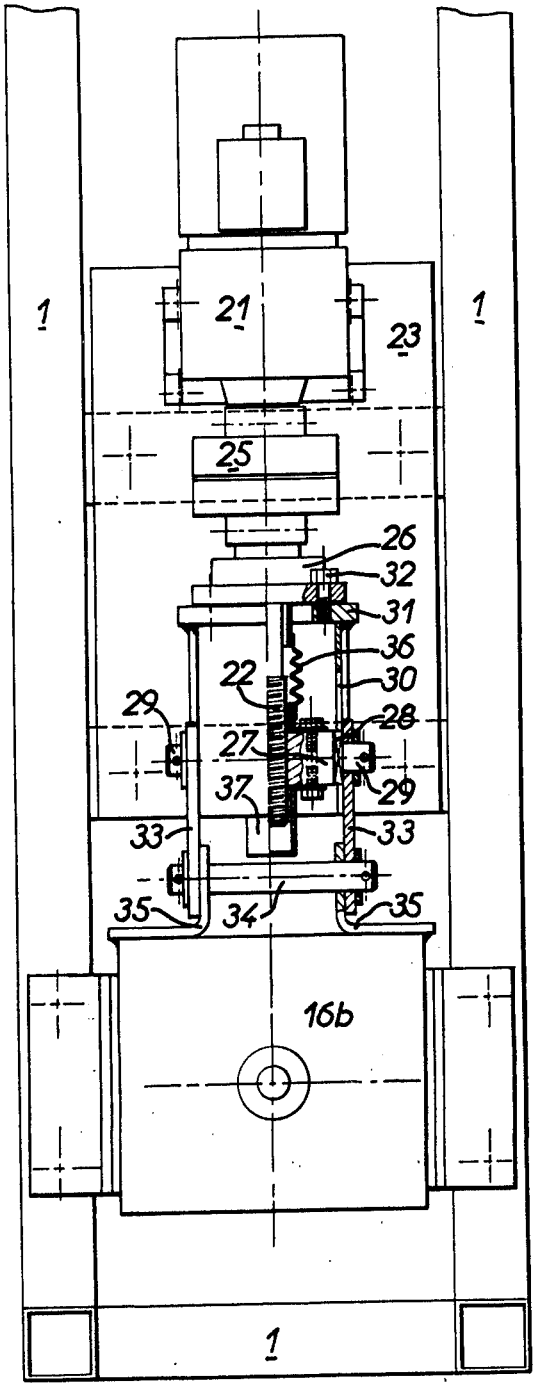
FIG. 3 is a side elevational view with parts broken away of the mechanism shown in FIG. 2.
Figure 5:
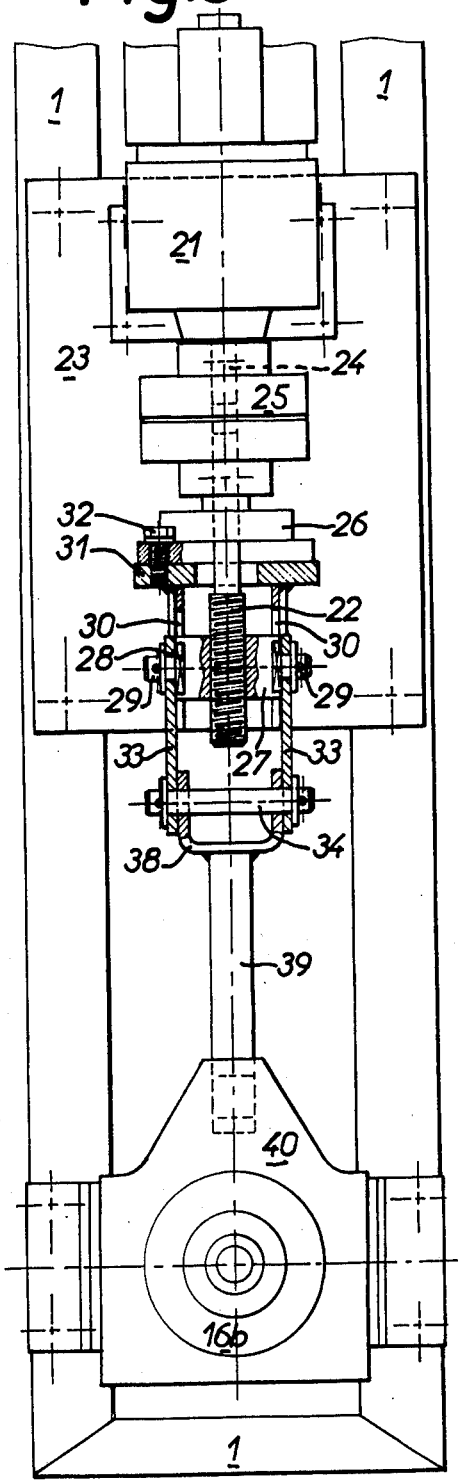
FIGS. 4 and 5 correspond to FIGS. 2 and 3, respectively, but illustrate a modified form of embodiment of the same mechanism.
Figure 4:
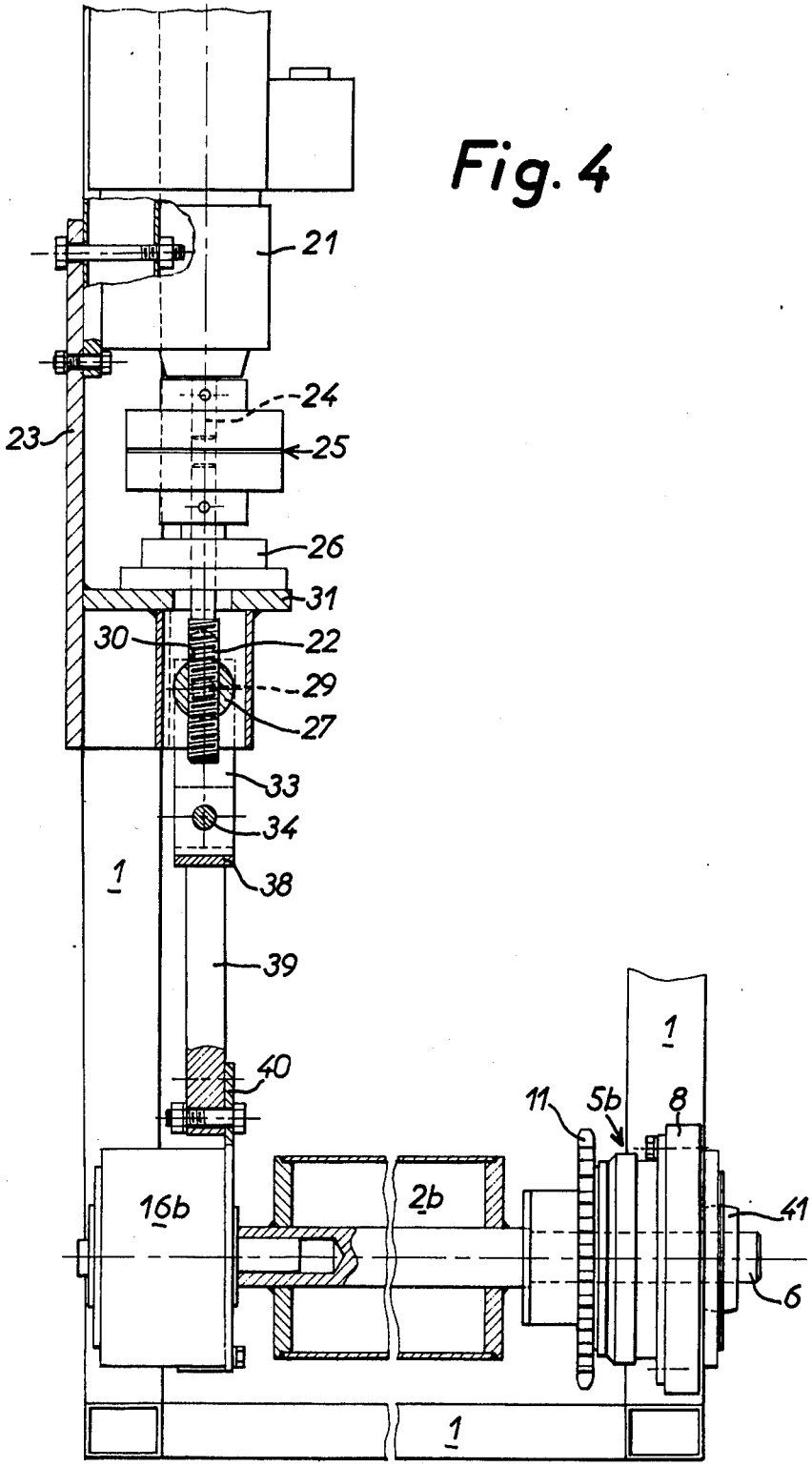

The various component elements of the display panel according to this invention are shown in FIG. 1, and FIGS. 2 and 3 illustrate a panel designed for posters of larger size than those utilized with the panel of FIGS. 4 and 5.

The panel illustrated comprises essentially:

(a) A frame structure exemplified in FIGS. 2 to 5;

(b) A pair of horizontal spools 2a, 2b rotatably mounted in the frame 1, namely a top spool and a bottom spool;

(c) A band 3 consisting of successive posters (FIG. 1) and wound on the bottom spool 2b;

(d) A conventional electric motor 4 disposed on one side of the frame structure 1 and driving the spools 2a, 2b by turns, via suitable magnetic disk clutches 5a, 5b each mounted at one end of the shafts of spools 2a, 2b, respectively.

The disk clutches 5a, 5b are also of conventional design. Clutch 5b is shown in section in FIG. 2 as being mounted on one end of shaft 6 of spool 2b and consisting of a winding 7 welded to a reaction member 8 and of a disk 9 coupled to said shaft 6 by means of a key 10 and also via a plate 13 to a sprocket wheel 11 driven through a roller chain 12 from motor 4. Roller bearings 14 are disposed between shaft 6 and wheel 11, on the one hand, and said reaction member 8, on the other hand. In the engaged position the plate 13 and disk 9 are rigidly coupled and the wheel 11 drives the shaft 6; under these conditions, the reaction member 8 (which is not secured to the frame structure 1, since spool 2b is on the other hand adapted to assume an inclined position in the vertical plane) engages said frame structure 1 via a shoulder 15 provided on its outer wall.

(e) A pair of torque limiting devices 16a, 16b, of the permanent magnet type, exerting a continuous braking force on each spool 2a, 2b, respectively. These torque limiters are of conventional type and capable of efficiently and reliably tensioning the poster band 3; the bottom torque limiter 16b is not rigid with the frame structure 1;

(f) A proximity detector 17 (FIG. 1) for centering the posters; this detector, located at mid-height of the display panel on the inner edge of the poster band 3, is adapted to detect the presence of a full poster in front of the panel window and stopping at that moment the motor 4 during a predetermined time period under the control of a suitable time switch (not shown); a piece of metal adhesive tape is applied at the proper location on the edge of each poster and the latter is stopped automatically as a consequence of the passage of this tape in front of the proximity detector;

(g) Other proximity detectors 18a, 18b, disposed the one at the top and the other at the bottom, also on the internal edge of the poster band, for detecting the passage of the last poster in front of the observation window and reversing the direction of motion of the band 3. At either end of the poster band a piece of metal tape opposite the position detection tape is applied, the direction of the winding movement being obtained when the passage of this piece of tape actuates the proximity detector.

Therefore, the movement of the poster band 3 can easily be programmed.

(h) A device adapted to correct the faulty winding of the poster band when this faulty winding occurs for anyone of the above-mentioned reasons.

In the drawing, this device is only associated with the bottom spool 2b and consists of a screw-jack 19 adapted to set the bottom spool 2b in the proper inclined position in order to compensate for an improper winding of the poster band 3. This device is controlled by a pair of photocells 20a, 20b each registering with the outer edge of the poster band 3 and, for the sake of convenience, disposed at mid-height of the display panel.

If the poster band 3 travels regularly, i.e., normally to the axes of spools 2a, 2b, the cells 20a, 20b are not energized. If not, one of the cells 20a or 20b is no more properly illuminated by its associated light source and thus an electric pulse is generated for controlling the operation of the screw-jack 19.

This screw-jack 19 has a different structure, according as it is intended for a large-size display panel (FIGS. 2 and 3) or for a small-size display panel (FIGS. 4 and 5).

The screw-jack illustrated in FIGS. 2 and 3 comprises a motor and reduction gear unit 21 controlling a vertical screw shaft 22. This unit 21 is secured to the frame structure 1 by means of a mounting plate 23. The shaft 24 of the unit 21 is connected to the screw 22 by means of an elastic coupling 25. The screw 22 is guided in its upper portion by an axial bearing plate 26. An internally screw-threaded socket 27 is in constant engagement with the screw shaft 22. This socket 27 has substantially the shape of a cylinder having a horizontal axis and has formed at each end a flat surface 28 and comprises on each side a horizontal stud 29.

The socket 27 is guided during its up- or down movement, according to the direction of rotation of screw 22 (which is bounded by limit switches, not shown), by a pair of vertical slideways 30 located in the vicinity of said flat faces 28. These slideways 30 are secured at their upper ends to a supporting washer 31 rigid in turn with the bearing plate 26 through a screw and nut assembly 32, and with the mounting plate 23 rigid with the frame structure 1.

Pivoted to each stud 29 of socket 22 is the upper end of a link 33. The lower ends of the two links 33 are pivoted on a horizontal pin 34 co-acting with the torque limiter 16b mounted on the bottom spool 2b by means of angle members 35.

In addition, the screw 22 is protected, in the vicinity of its upper end, by a bellows 36, and the section thereof carrying the socket 27 is protected by a dust cap 37 mounted on said socket 27 and attached to the bellows 26.

The screw-jack controlling the inclination of bottom spool 2b in the case of a display panel of relatively small size (FIGS. 4 and 5) is substantially similar to the one described hereinabove, except that the horizontal pin 34 is coupled to the torque limiter 16b by means of a U-shaped strap 38 having its base rigidly connected to a depending rod 39 controlling the bottom spool 2b. The arms 38a of strap 38 engage the lower inner ends of links 33 and are adapted to co-act with said pin 34. On the other hand, rod 39 is rigidly secured to a plate 40 carried by the torque limiter 16b.

The shaft of the bottom spool 2b is mounted at the end supporting the disk clutch 5b in a self-aligning or spherical bearing 41 (see FIGS. 1, 2 and 4).

Assuming that the poster band 3 being taken up by spool 2b has drifted to the left (FIG. 1). Photocell 20a will be energized and control the screw-jack 19 so that the spool 2b be inclined in order to take up the proper winding of the paper band. This actuation of screw-jack 19 is discontinued when this result is obtained, since photocell 20a is no more energized.

To sum up, any lateral movement or drift of the poster is attended immediately by the necessary inclination of the spool 2*b*, whether the band is being wound on this spool 2*b* or on the other spool 2*a*.

Of course, the above description is given by way of illustration, not of limitation, since various modifications and changes may be brought to the forms of embodiment described and illustrated herein without departing from the basic principles of the invention as set forth in the appended claims.

I claim:

1. In a display panel structure for movable posters comprising a frame, two parallel spools mounted on the frame to rotate about their axes which are spaced apart in a first plane, a band having longitudinally extending edges and carrying posters arranged in succession on the band, the band having ends respectively connected to the spools and being, in a region of the band between the spools, substantially contained in a second plane parallel to said first plane, drive means for driving in rotation selectively one of the spools at a time so that a first of the spools is a band take up spool and a second of the spools is a band feed spool and vice-versa, and two permanently operative detecting means mounted on the frame and respectively associated with said edges for detecting transverse drift of the band in either transverse direction; the improvement comprising means for correcting the drift of the band which comprise means mounting the first spool on the frame to be inclinable in either direction relative to the second spool in said first plane and shifting means associated with and responsive to the two detecting means and connected to the first spool for inclining the first spool relative to the second spool in said first plane in a first direction when one of the detecting means detects a drift and in a second direction when the other of the detecting means detects a drift and thereby cause the band to move in a direction opposed to the drift.

2. The display panel structure claimed in claim 1, wherein the means mounting the first spool on the frame comprise means pivotally mounting one end of the first spool on the frame, the opposite end of the first spool being free to move in said first plane.

3. The display panel structure claimed in claim 2, wherein the shifting means comprise a screw-jack mechanism having an output member connected to the first spool adjacent to the free end of the first spool, a reversible electric motor drivingly connected to the screw-jack mechanism and a supply circuit for the motor, the two detecting means being inserted in the supply circuit and operative to cause operation of the motor in either direction in accordance with the direction of the drift to be corrected.

4. In a display panel structure for movable posters comprising a frame, two parallel spools mounted on the frame to rotate about their axes which are spaced apart in a first plane, a band having longitudinally extending edges and carrying posters arranged in succession on the band, the band having ends respectively connected to the spools and being, in a region of the band between the spools, substantially contained in a second plane parallel to said first plane, drive means for driving in rotation selectively one of the spools at a time so that a first of the spools is a band take up spool and a second of the spools is a band feed spool and vice-versa, and two permanently operative detecting means mounted on the frame and respectively associated with said edges for detecting transverse drift of the band in either transverse direction; the improvement comprising in combination braking means associated with the two spools for exerting a limited braking effect on the rotation of the spools whereby when one of the spools is being rotated by the drive means the other spool tends to hinder the unwinding of the band and thereby puts the band under longitudinal tension, and means for correcting the drift of the band which comprise means mounting the first spool on the frame to be inclinable in either direction relative to the second spool in said first plane and shifting means associated with and responsive to the two detecting means and connected to the first spool for inclining the first spool relative to the second spool in said first plane in a first direction when one of the detecting means detects a drift and in a second direction when the other of the detecting means detects a drift and thereby cause the band to move in a direction opposed to the drift.

* * * * *